US006087637A

United States Patent [19]

Fischer et al.

[11] Patent Number: 6,087,637

[45] Date of Patent: Jul. 11, 2000

[54] TABLE-TOP COOKING APPLIANCE

[75] Inventors: Dietmar Fischer, Mainz; Wolfgang Korinski, Sörgenloch; Bernd Schultheiss, Schwabenheim; Helmut Statzner, Oestrich-Winkel, all of Germany

[73] Assignee: Schott-Geraete GmbH, Hofheim, Germany

[21] Appl. No.: 09/342,386

[22] Filed: Jun. 29, 1999

[30] Foreign Application Priority Data

Jun. 30, 1998 [DE] Germany ..... 298 11 628 U

[51] Int. Cl.[7] ..... H05B 3/68

[52] U.S. Cl. ..... 219/465.1; 219/452.11; 219/443.1

[58] Field of Search ..... 219/443.1, 445.1, 219/446.1, 448.11, 451.1, 452.11, 460.1, 461.1, 462.1, 465.1, 466.1

[56] References Cited

U.S. PATENT DOCUMENTS

| | | | |
|---|---|---|---|
| 3,567,906 | 3/1971 | Hurko | 219/461.1 |
| 3,838,505 | 10/1974 | Doner | 219/452.12 |
| 4,357,526 | 11/1982 | Yamamoto et al. | 219/544 |
| 4,511,781 | 4/1985 | Tucker et al. | 219/626 |
| 4,733,056 | 3/1988 | Kojima et al. | 219/543 |
| 5,070,045 | 12/1991 | Comte et al. | 501/4 |
| 5,357,080 | 10/1994 | Vetter et al. | 219/445.1 |
| 5,508,495 | 4/1996 | Yahav et al. | 219/466.1 |
| 5,834,739 | 11/1998 | Lcokwood et al. | 219/468.1 |
| 5,944,324 | 8/1999 | Schultheis et al. | 277/637 |
| 5,958,272 | 9/1999 | Taplan et al. | 219/518 |

*Primary Examiner*—Sang Paik
*Attorney, Agent, or Firm*—Fulbright & Jaworski, LLP

[57] ABSTRACT

A tabletop cooking appliance (1) has at least one electrical heating element (3) associated with a burner, a residual heat indicator and a plate-like shaped part (2) of glass, glass ceramic or ceramic as heatable surface (2*a*) which closes the top of the housing of the cooking appliance as a cooking surface. The shaped part (2) forms the heatable surface (2*a*) and at least the front side (2*b*), and the shaped part (2) encloses the cooking appliance.

23 Claims, 1 Drawing Sheet

TABLE-TOP COOKING APPLIANCE

The invention relates to a table-top cooking appliance with at least one electrical heating element associated with a cooking surface, with the possibility of adjusting and displaying the heat output, with a residual heat display and a platform-like shaped part of glass, glass ceramic or ceramic as the heating surface which is the cook surface closing the top of the housing of the cooking appliance.

Table-top cooking appliances with an electric heating element associated with a burner and a heatable, planar surface of glass ceramic are known. The cook surface covers only the top of the cooking appliance and is held by framework which is sealed off from the cook surface and/or from the housing. The operating and/or indicating elements are arranged at an exposed place on the side of the housing.

Due to the said kind of construction of table-top cooking appliances, the housing is protected only at the top by the cook surface. Due to the complicated frame construction and the seals necessary for it the formation of indentations cannot entirely be prevented. The frame and its seal, the sides and bottom parts of the housing as well as the exposed operating controls and indicating means cannot be protected or cannot be protected completely against soiling and corrosion, e.g., by liquids that boil over. Therefore, some loss of safety of operation and greater wear and tear on the parts thus impaired cannot be excluded.

In former table-top cooking appliances of known type, no finger recesses are provided on the sides for a sure grip. To date there has been no possibility of knowing through active status displays the actual temperature of the burner or of attaching individual cooking appliances together by simple mechanical couplings to form a larger, compact unit.

The invention stated in claim 1 is addressed to the problem of creating a table-top cooking appliance which avoids the described disadvantages, which is of especially simple construction and can be manufactured at low cost with little assembly cost, which is easy to handle, safe to operate and control, easy to maintain, of mechanically stable construction with low total weight and good thermal insulation, and whose entire functional working area is covered continuously in one piece without indentations. The invention is furthermore addressed to the problem of avoiding exposed operating means and confining frame structures.

This problem is solved by a table-top cooking appliance wherein the shaped part consists of glass, glass ceramic or ceramic, the heatable surface and at least the front side is formed as a side part and the shaped part thus covers the cooking appliance continuously in one piece (closed) and especially also free of indentations. The heatable surface can form the cook surface and the front side can form the operating and/or display surface. To facilitate the operation of the appliance and the reading of the displays, the cook surface and the operating and display surface can, in a preferred embodiment, form an angle with one another between surfaces in the range of 100° and 160°, and especially is 130°.

According to a further embodiment of the invention the shaped part can form the heatable surface, the front side and two additional side parts, so that the shaped part thus covers the cooking appliance continuously and in one piece.

The shaped part can consist preferably of borosilicate glass, especially float borosilicate glass also tempered for certain applications, of glass ceramic, especially of translucent glass ceramic containing dark β-quartz solid solution as the chief crystal phase, or opaque, whitish β-spodumene as the chief crystal phase or of ceramic, especially a ceramic of high thermal conductivity such as ceramic containing silicon nitrite or silicon carbide.

As additional features of embodiment, the cooking appliance of the invention can include a stirring motor, especially for a variable speed stirring system, and the electrical heating elements, especially foil heating elements, radiant heatable elements, halogen heating elements and/or induction heating elements.

The control means, especially for the ON/OFF function, for adjusting the heating power and for adjusting the stirring speed, are disposed on the operation and display surface, which can also be added on and combined modularly, and which is preferably made as an infrared-sensitive and/or capacitive touch panel. Likewise, display means, preferably as light-emitting diodes, especially also so-called "7-segment" displays or bar graph displays, are disposed on the operation and display surface, especially for visual control of the heat power control, stirring speed and residual heat.

The housing is laid upon the shaped part. It is preferably in a bipartite form, with a frame part corresponding to the geometry of the shaped part, rests on the shaped part, and with a pan-like bottom part corresponding to the geometry of the frame part, and the housing contains the functioning elements necessary for the operation of the cooking appliance, such as heating elements, their connections and fastenings and a thermal insulating material. The housing parts are fastened together by snap-fastening, by cementing and/or by screws. The bottom part and frame part are of tridimensional shape formed of pressure-cast aluminum and/or injection molded thermoplastic and/or hot-pressed thermosetting plastic and/or a bent sheet metal housing, wherein the frame part of the bipartite housing can consist of a different material than the bottom part. In a greatly preferred embodiment at least one housing part can consist of thermosetting plastic reinforced with long fibers.

Cementing the molded body to the housing, for example with a silicone material known on the market, is advantageous.

For the ventilation of the cooking appliance the frame part and/or the bottom part of the housing can have openings.

Especially safe to operate is a configuration of the cooking appliance with finger recesses on the lateral part of the frame.

As a practical expansion, the cooking appliance can be equipped with devices formed on the frame part for fastening holders, e.g., upstanding hangers.

A plurality of cooking appliances can be connected together with appropriate clips and coupled mechanically to form a larger unit.

By the invention it is brought about that, with the new shaping of the cook surface, a continuous, integral and indentation-free covering of the surface as well as at least the front side is obtained, which closes off the top of the housing of the cooking appliance. Complex frames and gasket designs are eliminated. The known advantageous properties of glass, glass ceramic or ceramic, such as ease of cleaning, high thermal stability, great resistance to chemical attack, at preferred material for forming the burner in the cooking area are transferred at least to the front side for protection of the housing as well as of the operating and display elements. The integration of the operating and display elements into the surface of the front side of the integral covering offers an especially good protection against external influences. Active status displays, such as for example the present heat setting and/or the present temperature of the burner, increase the convenience of operation and the safety of operation; the residual heat indication warns the user against the danger of burns. At the same time the residual heat can be rationally utilized for preheating an additional pot to save energy. Secure operation and control of the cooking appliance is additionally permitted by the inclination of the front side away from the cook surface. The simple and weight-saving bipartite construction of the housing permits low-cost manufacture, assembly and maintenance. The stable and hermetically sealed housing of noncombustible materials provides for trouble-free and enduringly stable utilization. By means of recessed finger holds on the side portions of the housing the cooking appliance can be safely handled. Devices on the housing for easy attachment of holders and for the mechanical coupling of individual cooking appliances to form a larger unit facilitate secure and uncomplicated working with it.

For ease in operating the table-top cooking appliance the color of the surface can be chosen so as to provide good contrast with the material being heated and any possible stains can easily be seen.

Additional protection of the housing is achieved in that the shaped part of glass, glass ceramic or ceramic forms the heating surface, the front and two additional sides, and covers the cooking appliance continuously, integrally and without indentations.

FIGS. 1 and 2 will serve to further explain the invention, by showing one possible embodiment of the invention, but the invention is not to be limited to this embodiment.

Figure 1:
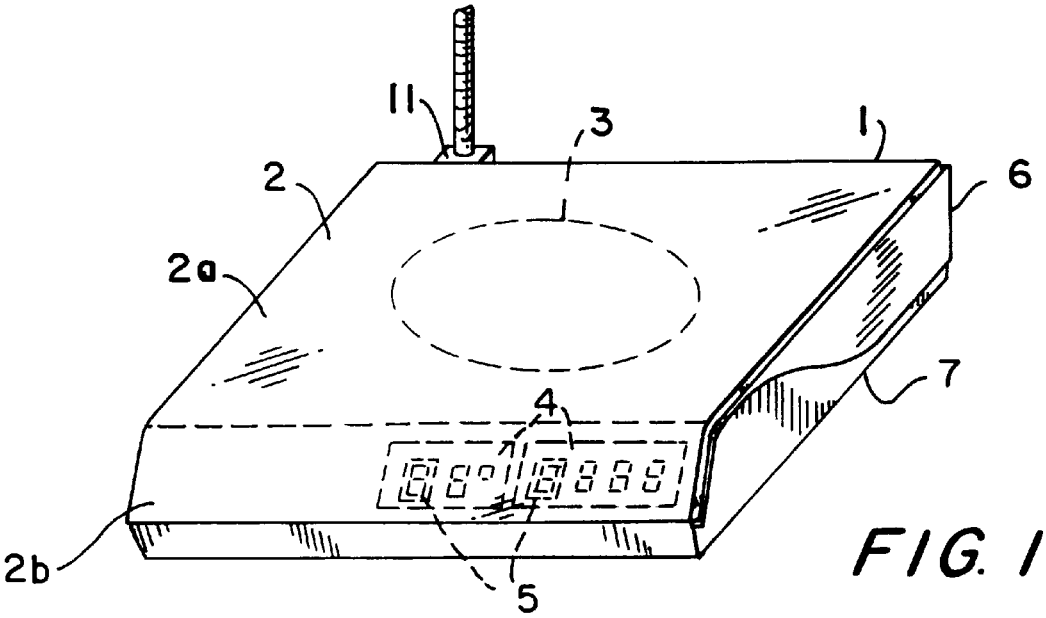
FIG. 1 is a perspective view of a table-top cooking appliance according to the invention.
Figure 2:
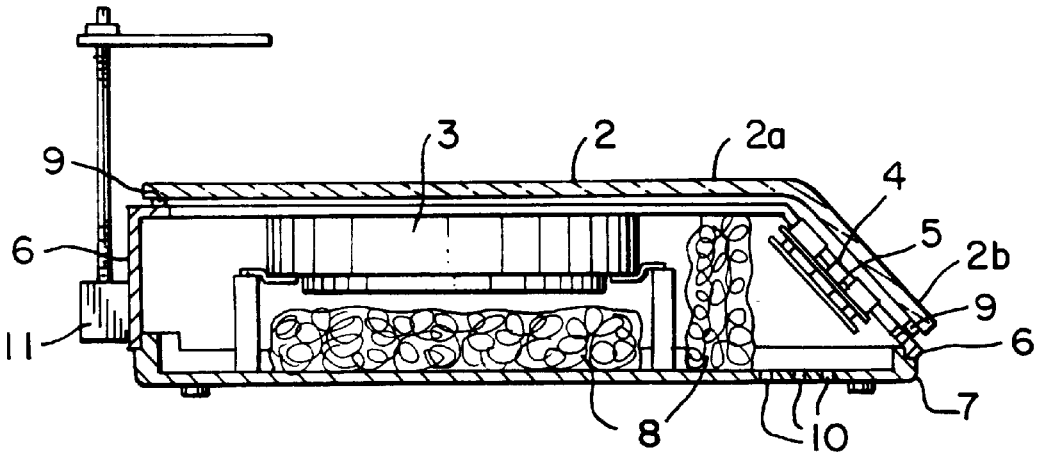
FIG. 2 is a side view of a cross section of the table-top cooking appliance of FIG. 1.

In the figures a table-top cooking appliance 1 according to the invention is represented; its main element is a platform-like shaped part 2 of glass, glass ceramic or ceramic as the heatable surface 2*a* which covers continuously, integrally and indentation-free the top of the housing consisting of the frame part 6 and bottom part 7 as cooking surface and at least continuing to the front side 2*b*.

The portion of the shaped part 2 which forms the front side 2*b* is equipped with integrated operating elements 4 protected under the surface, e.g., infrared touch panels and display elements 5, e.g., for indicating the current temperature of the surface 2*a*, and is tilted down from the surface 2*a* to facilitate operating the cooking appliance and reading the displays.

An electric heating element 3, e.g., a radiant element or foil element and/or a stirring motor are disposed under the surface 2*a*.

The simply constructed housing is in two parts, with a frame part 6 on which the shaped part 2 rests, and with a pan-like bottom part 7 corresponding to the geometry of the frame part 6, and the housing contains the operating elements necessary for the operation of the cooking appliance 1, and their connections and fastening devices. The frame part 6 and the bottom part 7 of the housing, as well as the operating elements 4 and display elements 5 are thermally insulated by known thermal insulating materials 8 against the electrical heating element 3. Ventilation openings 10 are provided in the housing.

By snap-fastening means, by cementing and/or by screw fastening the housing parts are joined together and hermetically sealed to the shaped part 2 by sealing with a silicone material 9.

On the frame part 6 of the housing are molded-in devices for attaching holders 11, e.g., upstanding hangers.

Other alternative variants (not represented here) are described below.

The shaped part 2 is designed such that two additional side parts are formed on the heated surface and on the front side 2*b*, and that the shaped part 2 of the cooking appliance 1 is continuous, made in one piece, and free of indentations.

Recesses for the fingers are provided on the side of the housing for easy and secure handling.

To be able to couple several cooking appliances together to form a larger unit, coupling means are formed on the side of the housing.

What is claimed is:

1. A table-top cooking appliance comprising a housing having a top and a front side, at least one electrical heating element associated with a burner, a residual heat indicator and a plate-like shaped part of glass, glass ceramic or ceramic as heatable surface which closes off the top of the housing of the cooking appliance as a cooking surface, wherein the shaped part of glass, glass ceramic or ceramic forms the heatable surface and at least the front side as a side part and the shaped part thus covers the cooking appliance continuously and in one piece wherein devices are formed on the housing for fastening holders.

2. The cooking appliance according to claim 1, wherein the heatable surface forms the cooking surface and the front side forms an operating or display surface.

3. The cooking appliance according to claim 2, wherein the cooking surface and the operating or display surface form an angle with one another which facilitates the operation of the appliance and the reading of the displays.

4. The cooking appliance according to claim 3, wherein the angle between the surfaces is between 100° and 160°.

5. The cooking appliance according to claim 1, wherein the shaped part of glass, glass ceramic or ceramic forms the heatable surface, the front side and two other side parts, and the shaped part thus covers the cooking appliance continuously and in one piece.

6. The cooking appliance according to claim 1, wherein the shaped part is formed from borosilicate glass.

7. The cooking appliance according to claim 6, wherein the shaped part is formed from tempered borosilicate glass.

8. The cooking appliance according to claim 1, wherein the shaped part is formed from a glass ceramic.

9. The cooking appliance according to claim 1, wherein the shaped part is formed from ceramic.

10. The cooking appliance according to claim 1, further comprising a stirring device.

11. The cooking appliance according to claim 1, wherein electric heating elements are selected from the group consisting of foil heating elements, radiation heating elements, halogen heating elements and induction heating elements.

12. The cooking appliance according to claim 1, wherein the operating elements are arranged on an operating surface.

13. The cooking appliance according to claim 12, wherein said operating surface is in the form of a touch panel.

14. The cooking appliance according to claim 13, wherein the functions of the touch panel are infrared-sensitive or capacitative.

15. The cooking appliance according to claim 1, wherein the display elements are disposed on the operating/display surface.

16. The cooking appliance according to claim 15, wherein the display elements are light-emitting diodes.

17. The cooking appliance according to claim 1, wherein the housing on which the shaped part rests is configured as a frame part corresponding to the geometry of the shaped part on which the shaped part rests and having a pan-like bottom part corresponding to the geometry of the frame part, said housing containing the functional elements necessary for the operation of the cooking appliance.

18. The cooking appliance according to claim 17, wherein the housing parts are joined together by snaps, by cement or by screws.

19. The cooking appliance according to claim 1, wherein the housing parts are formed tridimensionally and are made of pressure-cast aluminum a injection-molded thermoplastic a hot-pressed thermoset or a bent sheet-metal housing.

20. The cooking appliance according to claim 19, wherein the frame part of said housing comprises a different material than the bottom part.

21. The cooking appliance according to claim 19, wherein at least one housing part comprising a long fiber-reinforced thermoset.

22. The cooking appliance according to claim 1, wherein the shaped body is cemented to the housing with a silicone material.

23. The cooking appliance according to claim 1, wherein the housing has ventilation openings therein.

* * * * *

UNITED STATES PATENT AND TRADEMARK OFFICE

CERTIFICATE OF CORRECTION

PATENT NO. : 6,087,637

DATED : July 11, 2000

INVENTOR(S) : Fischer, et. al.

It is certified that error appears in the above-identified patent and that said Letters Patent is hereby corrected as shown below:

In cover page, in the section entitled Inventors, change "Schultheiss" to - - Schultheiß - -.

In cover page, in the section entitled Assignee, change "Schott-Geraete" to - -Schott- Geräte - -.

In column 3, line 3, change "bums" to - - burns - -.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*